US006413057B1

(12) United States Patent
Hong et al.

(10) Patent No.: US 6,413,057 B1
(45) Date of Patent: Jul. 2, 2002

(54) PLURALITY OF OUTER RESONANCE SPRINGS FOR A LINEAR COMPRESSOR

(75) Inventors: Eon Pyo Hong, Seoul; Hyeong Kook Lee, Kunpo, both of (KR)

(73) Assignee: LG Electonics (KR)

( * ) Notice: Subject to any disclaimer, the term of this patent is extended or adjusted under 35 U.S.C. 154(b) by 0 days.

(21) Appl. No.: 09/504,399

(22) Filed: Feb. 15, 2000

(30) Foreign Application Priority Data

Aug. 19, 1999 (KR) ..... 99/34392

(51) Int. Cl.[7] ..... F04B 17/04

(52) U.S. Cl. ..... 417/416; 92/130 R; 92/130 B; 92/130 C; 92/130 D; 92/131

(58) Field of Search ..... 417/415, 416, 417/545, 550, 902; 92/130 R, 130 B, 130 C, 130 D, 131

(56) References Cited

U.S. PATENT DOCUMENTS 3,325,085 A * 6/1967 Gaus ..... 417/417
3,788,778 A * 1/1974 Miller ..... 417/417
5,993,178 A * 11/1999 Park et al. ..... 417/545
6,089,836 A * 7/2000 Seo ..... 417/417

* cited by examiner

*Primary Examiner*—Michael Koczo
*Assistant Examiner*—William H Rodriguez
(74) *Attorney, Agent, or Firm*—Ostrolenk, Faber, Gerb & Soffen, LLP

(57) ABSTRACT

A linear compressor including: a cover fixed at a rear side of a frame; a cylinder fixedly installed in a horizontal direction at the center of inside of the frame; an inner stator assembly fixedly installed at the frame in a state that its inner circumferential surface contacts an outer circumferential surface of the cylinder; an outer stator assembly fixedly installed at the frame, being spaced apart from the inner stator assembly to the outer periphery for a predetermined distance; a magnet assembly incorporated with a piston, making a linear reciprocal movement with one end portion thereof inserted in the gap between the inner stator assembly and the outer stator assembly; at least one inner resonance spring supported by the magnet assembly; and a plurality of outer resonance springs supported between the magnet assembly and the cover. With this construction, the gap between the cylinder and the inner stator assembly is is removed, reducing the inner diameter of the inner stator assembly, according to which the inner diameter of the magnet assembly is minimized, remarkably reducing the amount of the magnet to be used and the size of the motor, and thus, its production cost can be much reduced. In addition, since the inner resonance springs or the outer resonance spring are provided in plural number, its spring force can be dispersed and the mechanical reliability of the magnet assembly is highly improved.

10 Claims, 6 Drawing Sheets

PLURALITY OF OUTER RESONANCE SPRINGS FOR A LINEAR COMPRESSOR

BACKGROUND OF THE INVENTION

1. Field of the Invention

The present invention relates to a linear compressor, and more particularly, to a linear compressor in which an inner circumferential surface of an inner stator assembly is attached onto an outer circumferential surface of a cylinder to reduce an inner diameter of a magnet assembly, thereby reducing the amount of magnet used and the size of the equipment.

2. Description of the Background Art

FIG. 1 shows a linear compressor in accordance with a conventional art. As shown in the drawing, a general linear compressor is driven by a linear motor consisting of an inner stator assembly 4A, an outer stator assembly 4B, that is, a stator, and a magnet assembly 5, that is, the rotor.

The linear compressor includes a compression unit C installed in a horizontal direction inside a casing V filled with oil at its bottom, for sucking, compressing and discharging, and a oil feeder O fixedly combined at the outside of the compression unit C, to provide oil to each contact sliding portion (sliding portion) of elements.

The structure of the compression unit C will now be described.

The compression unit C includes a circular frame 1, a cover 2 fixed at a rear side (in the description to be made hereinafter, the compression stroke direction of the piston is expressed as a front side, and its opposite direction is expressed as a rear side) of the frame 1; a cylinder 3 fixedly installed in the horizontal direction at the center of inside of the frame 1; an inner stator assembly 4A fixed at the frame 1 with a predetermined space 'p' from the outer circumferential surface of the cylinder 3; an outer stator assembly 4B fixedly installed at the frame 1 with a predetermined gap at the outer circumferential surface of the inner stator assembly 4A to form an induced magnetic flux along with the inner stator assembly 4A; a magnet assembly 5 inserted in the gap between the inner/outer stator assemblies 4A and 4B to make a linear reciprocal movement; a piston 6 incorporated to the magnet assembly 5 and sucking and compressing a coolant gas while being slidably moved inside the cylinder; an inner resonance spring 7A and an outer resonance spring 7B for inducing the magnet assembly 5 to continuously make a resonance movement in the gap between the inner/outer stator assemblies 4A and 4B.

The inner resonance spring 7A and the outer resonance spring 7B are all compressive coil springs. The inner resonance spring 7A is inserted between the outer circumferential surface of the cylinder and the inner circumferential surface of the inner stator assembly 4A so as to be extrapolated in the cylinder 3 at predetermined gaps, of which the front side end portion is supported by one end portion of the frame 1 and its rear side end portion is supported by the inner surface of the magnet assembly 5.

As shown in FIG. 2, the inner diameter D2 of the outer resonance spring 7B is formed to be the same as the inner diameter D1 of the inner resonance spring 7A, positioned to form a concentricity with the inner resonance spring 7A.

The front side end portion of the outer resonance spring 7B is supported by the outer surface of the magnet assembly 5 where the rear side end portion of the inner resonance spring 7A is supported, and its rear side end portion is supported by the inner surface of the cover 2 of the compression unit C.

Reference numeral 8 denotes a suction valve, 9 denotes a discharge valve assembly, d1 denotes the inner diameter of the inner stator assembly, d2 denotes the inner diameter of the magnet assembly, and S denotes a compression space.

The operation of the linear compressor of the conventional art constructed as described above will now be explained.

When a current is applied to the stator of the linear motor consisting of the inner stator assembly 4A and the outer stator assembly 4B and thus an induced magnetic flux is generated, the magnet assembly 5, that is, the rotor, inserted between the stators makes a linear reciprocal movement, according to which the piston 6 combined to the magnet assembly 5 moves reciprocally within the cylinder 3.

As the piston 6 moves reciprocally within the cylinder 3, the coolant gas flowing into the casing V is compressed in the cylinder 3 and then discharged by pushing the discharge valve assembly 8.

At this time, the inner resonance spring 7A elastically supporting the inside of the magnet assembly 5 inserted between the cylinder 3 and the inner stator assembly 4A and the outer resonance spring 7B elastically supporting the outside of the magnet assembly 5 store the liner reciprocal movement of the magnet assembly 5 to which the piston 6 is integrally combined as an elastic energy, induces a resonance movement of the magnet assembly 5 by converting the stored elastic energy to a linear movement.

However, as to the conventional linear compressor, since the inner resonance spring is inserted between the outer circumferential surface of the cylinder and the inner circumferential surface of the inner stator assembly, the inner diameter of the inner stator assembly is greater than that of the inner resonance spring. Accordingly, the inner diameter of a magnet holder of the magnet assembly inserted between the outer circumferential surface of the inner stator assembly and the inner circumferential surface of the outer stator assembly is enlarged. This causes the high-priced magnet needed for construction of the magnet assembly and required for the output of the motor to be enlarged, causing the size of the motor to be increased, as well as the production cost.

SUMMARY OF THE INVENTION

Therefore, an object of the present invention is to provide a linear compressor in which the amount of a magnet to be used is reduced by minimizing the size of the inner diameter of an inner stator assembly, thereby reducing a production cost of the compressor.

Another object of the present invention is to provide a linear compressor in which a plurality of the inner resonance springs or a plurality of outer resonance springs are provided, so that a reliability of the resonance movement of a magnet assembly is improved.

To achieve these and other advantages and in accordance with the purposed of the present invention, as embodied and broadly described herein, there is provided a linear compressor including: a cover fixed at a rear side of a frame; a cylinder fixedly installed in a horizontal direction at the center of inside of the frame; an inner stator assembly fixedly installed at the frame in a state that its inner circumferential surface contacts an outer circumferential surface of the cylinder; an outer stator assembly fixedly installed at the frame, being spaced apart from the inner stator assembly to the outer periphery for a predetermined distance; a magnet assembly incorporated with a piston, making a linear reciprocal movement with one end portion thereof inserted in the gap between the inner stator assembly and the outer stator assembly; at least one inner resonance spring supported by the magnet assembly; and a plurality of outer resonance springs supported between the magnet assembly and the cover.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Figure 1:
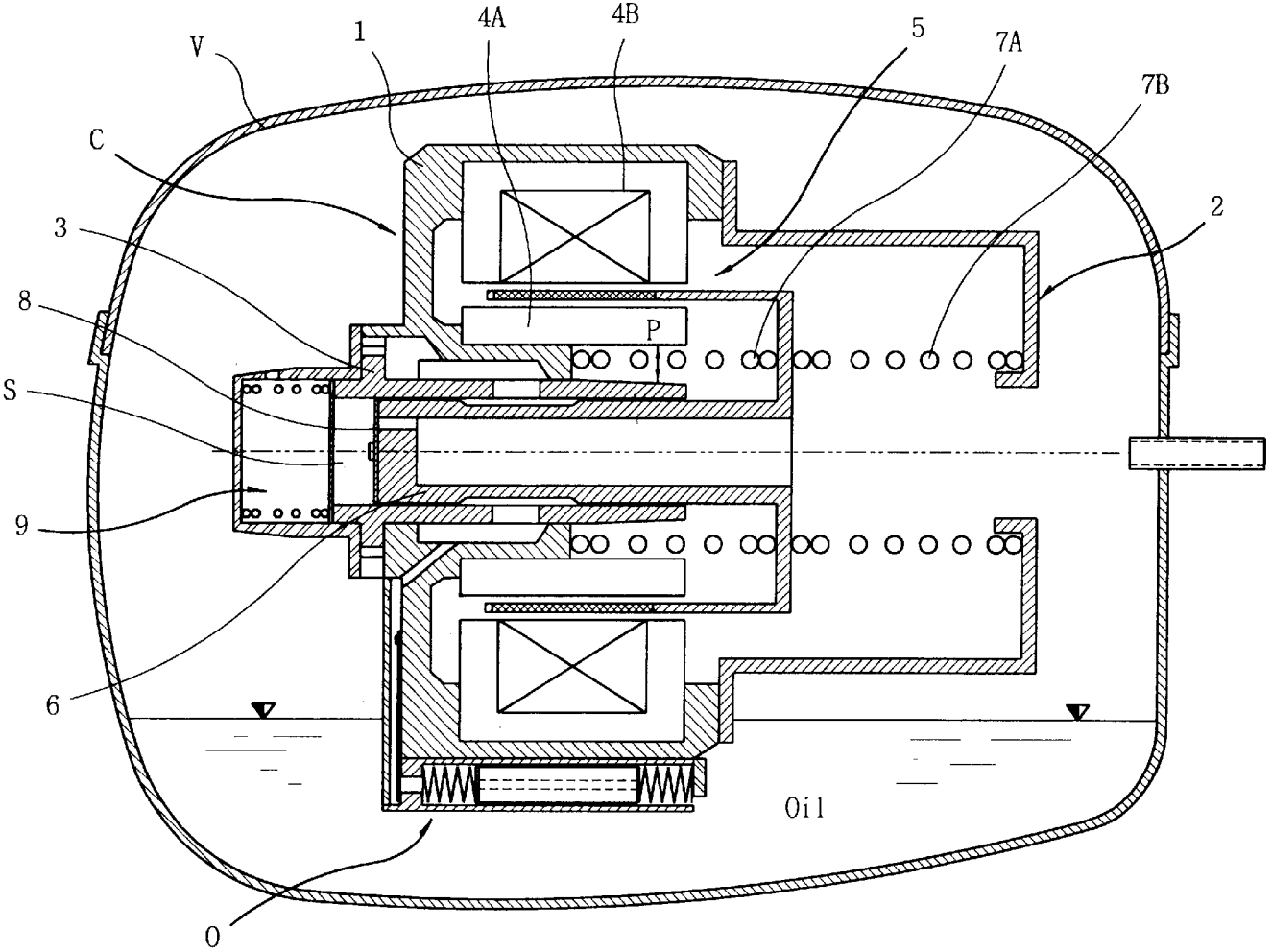
FIG. 1 CONVENTIONAL ART
FIG. 1 is a vertical-sectional view of a linear compressor in accordance with a conventional art.
Figure 2:
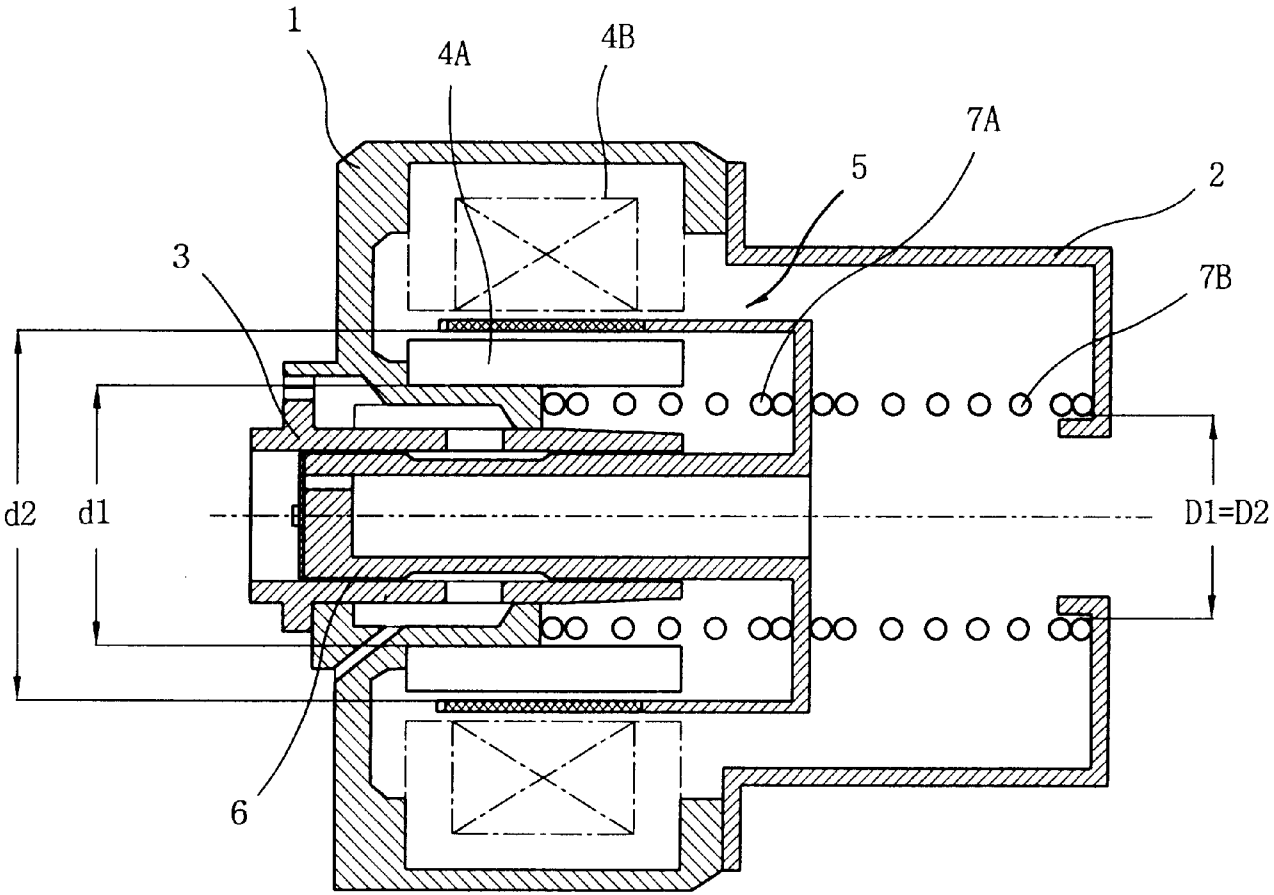
FIG.2 CONVENTIONAL ART
FIG. 2 is a schematic view showing a spring support structure of the linear compressor in accordance with the conventional art.

Reference will now be made in detail to the preferred embodiments of the present invention, examples of which are illustrated in the accompanying drawings.

In the following description, the same reference numerals as in the conventional art are used for the same elements as in the conventional ones.

Figure 3:
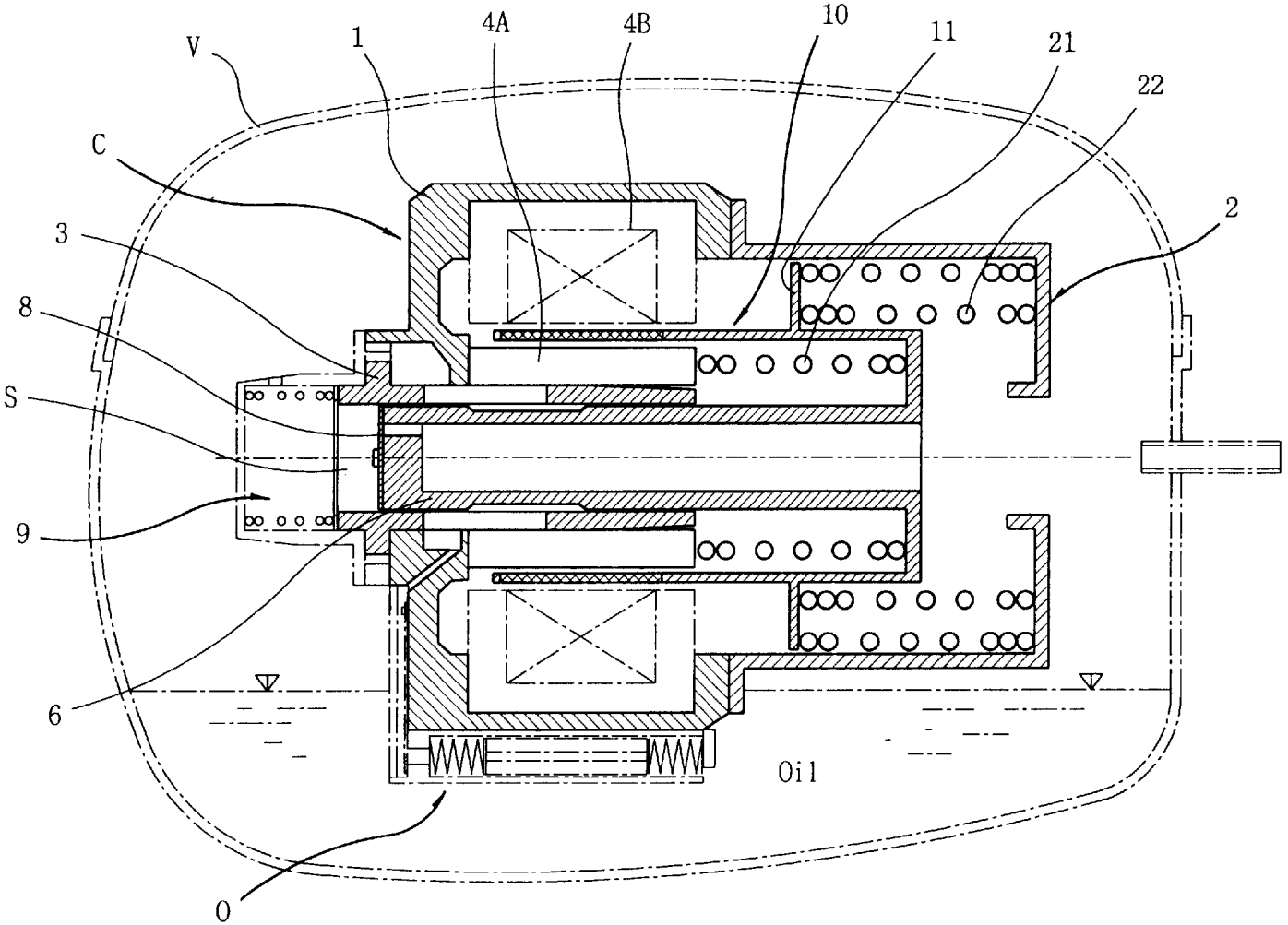
FIG. 3 is a vertical-sectional view of a linear compressor in accordance with the present invention.
Figure 4:
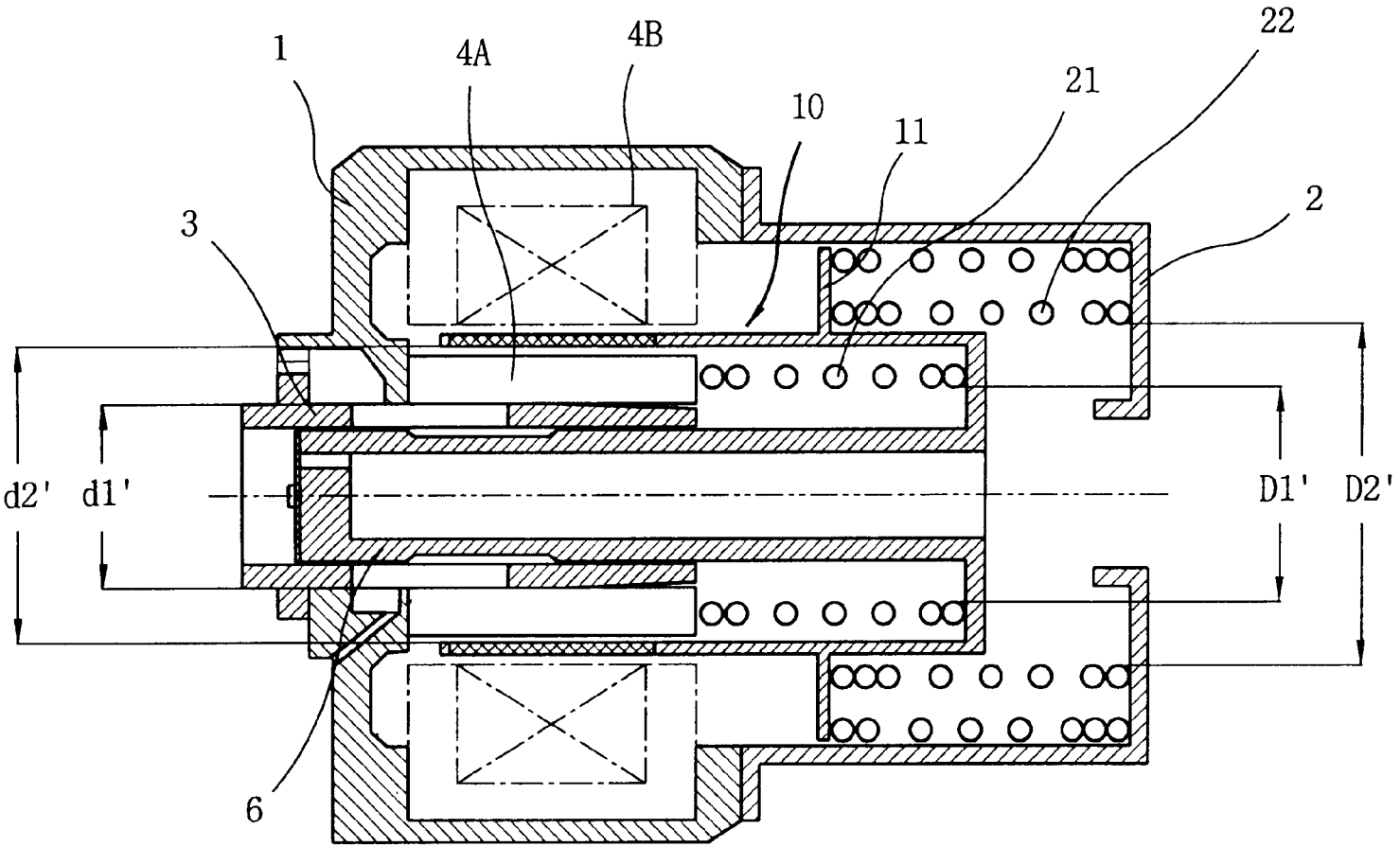
FIG. 4 is a schematic view showing a spring support structure of the linear compressor in accordance with first embodiment of the present invention.

FIG. 3 is a vertical-sectional view of a linear compressor in accordance with the present invention, and FIG. 4 is a schematic view showing a spring support structure of the linear compressor in accordance with first embodiment of the present invention.

As shown in the drawings, the linear compressor in accordance with the first embodiment of the present invention includes a circular frame 1; a cover 2 fixed at a rear side of a frame; a cylinder 3 fixedly installed in a horizontal direction at the center of inside of the frame; an inner stator assembly 4A fixedly installed at the frame in a state that its inner circumferential surface adhesively contacts an outer circumferential surface of the cylinder; an outer stator assembly 4B fixedly installed at the frame, being spaced apart from the inner stator assembly to the outer periphery for a predetermined distance; a magnet assembly 10 making a linear reciprocal movement with one end portion thereof inserted in the gap between the inner stator assembly and the outer stator assembly, and having a support portion 11 extended outwardly in the radial direction formed at a predetermined portion of its outer circumferential surface; a piston 6 incorporated with the magnet assembly 10; one inner resonance spring 21 inserted between the rear side end portion of the inner stator assembly 4A and the inner side surface of the magnet assembly 10; and a plurality of outer resonance springs 22 inserted between the rear side surface of the support portion 11 of the magnetic assembly and the inner side surface of the cover 2.

The structure of the inner and outer resonance springs 21 and 22 will now be described in detail.

As shown in FIG. 4, the inner resonance spring 21 is a sole compressive coil spring having a greater inner diameter D1' than the inner diameter d1' of the inner stator assembly.

One end of the inner resonance spring 21 is adhesively supported by the rear side end portion of the inner stator assembly 4A interpolated at the cylinder 3, and the other end thereof is adhesively supported by the inner side surface of the magnet assembly 10.

Meanwhile, each of the plurality of outer resonance springs 22 includes a compressive coil spring having a larger inner diameter than the inner diameter D1' of the inner resonance spring 21.

The overall form of the plurality of the outer resonance springs 22, as seen in the longitudinal direction of the spring, is that of a circle that is formed by having the diameter of the outer resonance spring 22 as its thickness, of which the diameter D2' is greater than the inner diameter D1' of the inner resonance spring 21 and the inner diameter d2' of the magnet assembly.

A second embodiment of the present invention will now be described.

Figure 5:
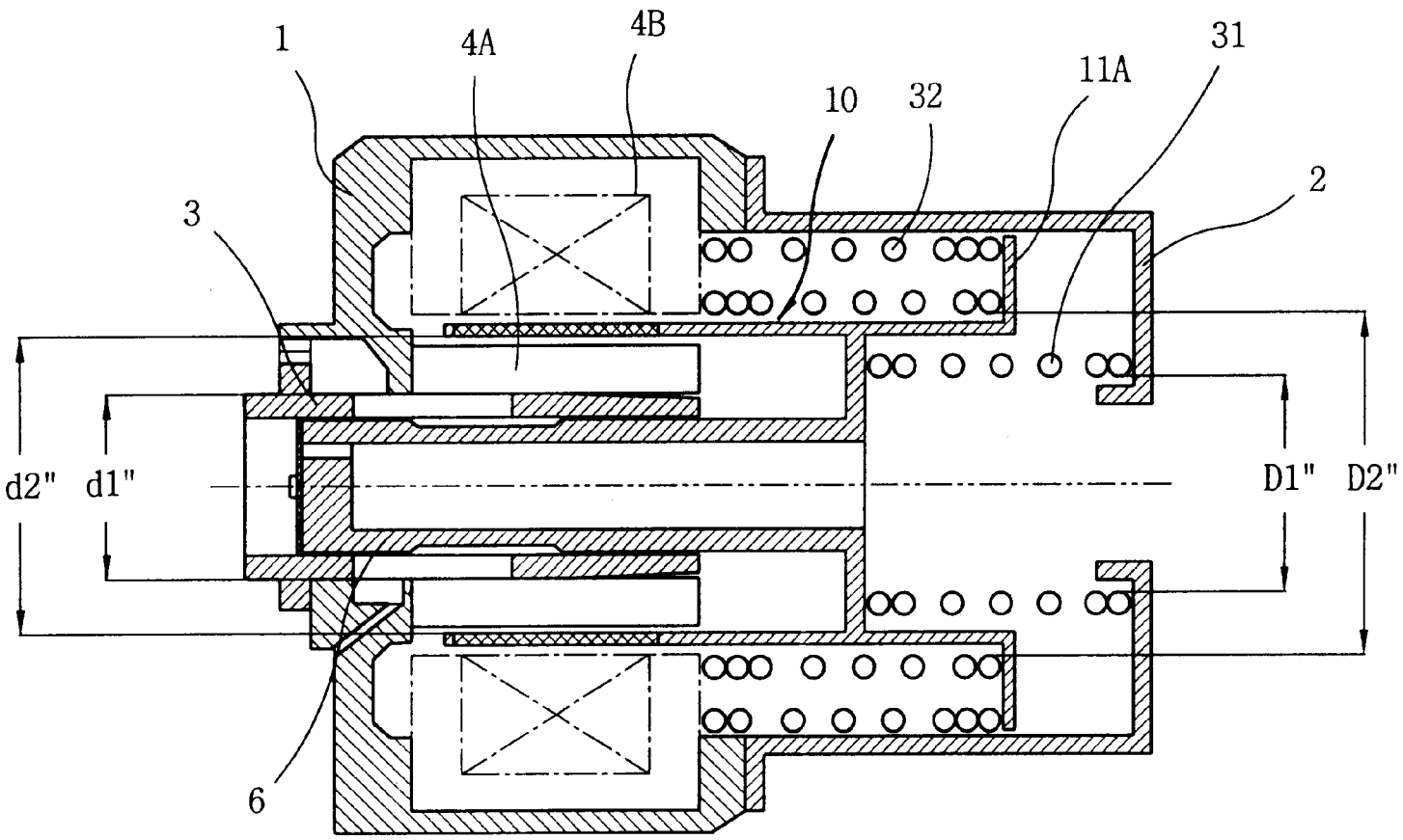
FIG. 5 is a schematic view showing a spring support structure of the linear compressor in accordance with second embodiment of the present invention.

FIG. 5 is a schematic view showing a spring support structure of the linear compressor in accordance with second embodiment of the present invention As shown in the drawing, a support portion 11A of the magnet assembly presented for the third embodiment is formed extended from the rear side end portion of the outer circumferential surface of the magnet assembly 10 by being bent outwardly in the radial direction.

The inner resonance spring 31 presented in the second embodiment of the present invention is a sole compressive coil spring having a greater inner diameter D1" than the inner diameter d1" of the inner stator assembly and smaller than the inner diameter d2" of the magnet assembly, of which one end portion is supported by the rear side end portion of the magnet assembly 10 and the other end portion thereof is supported by the inner side surface of the cover 2.

The one end portion of each of the plurality of outer resonance springs 32 is supported by the rear side end portion of the outer stator assembly 4B, while the other end portion thereof is supported by the front side surface of the support portion 11A of the magnet assembly.

The plurality of outer resonance springs 32 are a plurality of compressive coil spring each having a larger inner diameter than the inner diameter D1" of the inner resonance spring 31.

Overall form of the plurality of the outer resonance springs 32 from viewing in the lengthy direction of the spring is that a circle is formed by having the diameter of the outer resonance spring 32 as its thickness, of which the diameter D2" is greater than the inner diameter D1" of the inner resonance spring 31 and the inner diameter d2" of the magnet assembly.

A third embodiment of the present invention will now be described.

Figure 6:
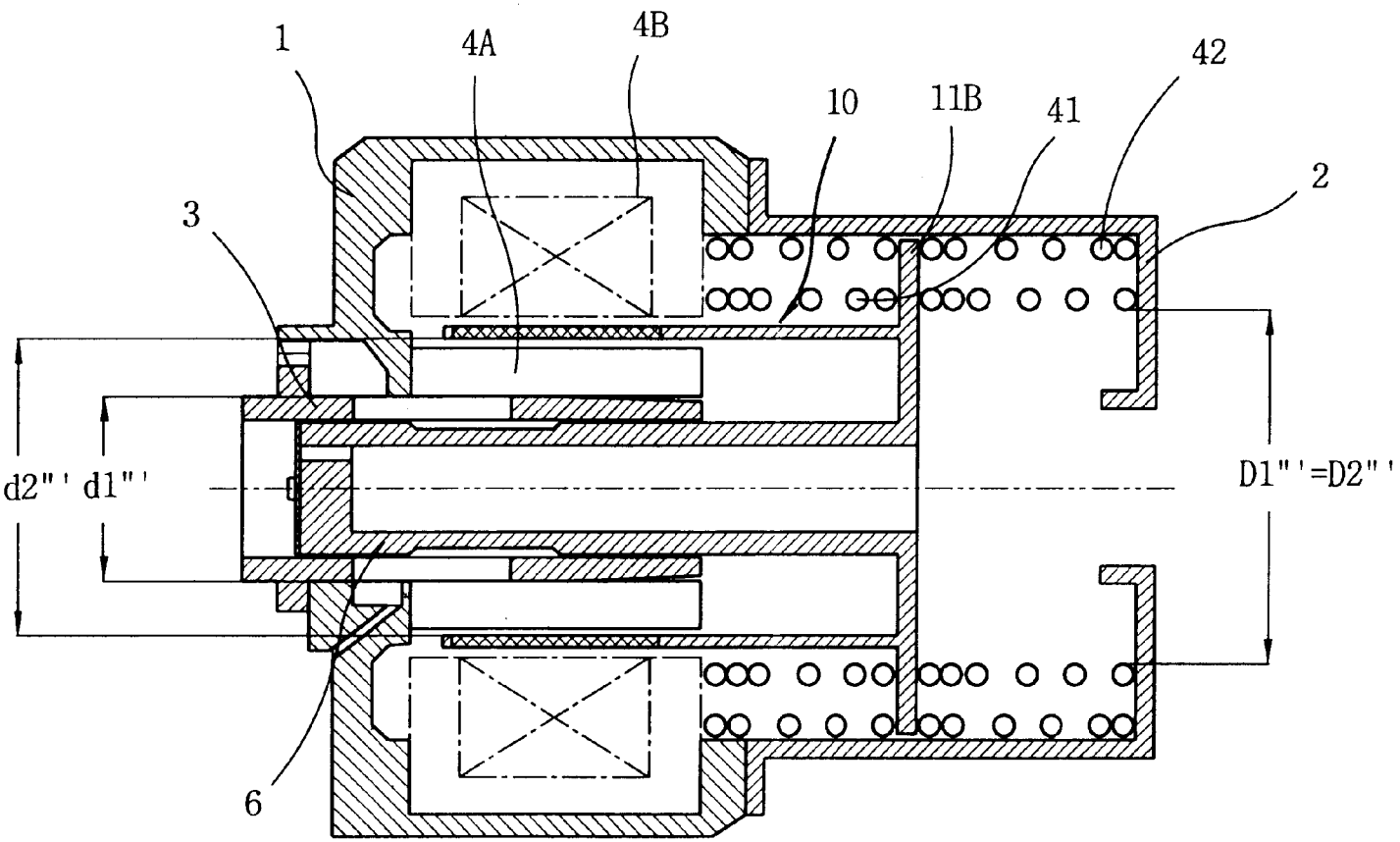
FIG. 6 is a schematic view showing a spring support structure of the linear compressor in accordance with third embodiment of the present invention.

FIG. 6 is a schematic view showing a spring support structure of the linear compressor in accordance with third embodiment of the present invention.

As shown in the drawing, a support portion 11B of the magnet assembly presented for the third embodiment is formed extended outwardly in the radial direction at the rear side end portion of the outer circumferential surface of the magnet assembly 10.

The one end portion of each of the plurality of inner resonance springs 41 is supported by the rear side end portion of the outer stator assembly 4B, while the other end portion thereof is supported by the front side surface of the support portion 11B of the magnet assembly.

The one end portion of each of the plurality of outer resonance spring 42 is supported by the rear side surface of the support portion 11B of the magnet assembly, while the other end portion thereof is supported by the inner side surface of the cover 2.

In this respect, overall form of the plurality of inner resonance springs 41 and the plurality of outer resonance springs 42 from viewing in the lengthy direction of the spring is that a circle is formed having the thickness of the inner and the outer resonance springs 41 and 42 that concentric with the same size, and the inner diameters D1''' and D2''' of each circle are greater than the inner diameter d2''' of the magnet assembly.

The embodiments of the present invention mentioned above are characterized in that the inner circumferential surface of the inner stator assembly 4A is adhesively combined to the outer circumferential surface of the cylinder so that the inner diameter of the inner stator assembly 4A is reduced, thereby minimizing the inner diameter of the magnet assembly 10.

Accordingly, the amount of the magnet (not shown) to be used required for construction of the magnet assembly 10 is consumed less, so that its production cost can be much reduced.

The reference numeral 8 denotes a suction valve, 9 denotes a discharge valve assembly, S denotes a compression space, and O denotes an oil feeder.

The operation of the linear compressor according to the present invention constructed as described above will now be described.

When a current is applied to the stator of the linear motor consisting of the inner stator assembly 4A and the outer stator assembly 4B and thus an induced magnetic is generated, the magnet assembly 10, that is, the rotor, inserted between the stators makes a linear reciprocal movement, according to which the piston 6 combined to the magnet assembly 10 moves reciprocally within the cylinder 3.

As the piston 6 moves reciprocally within the cylinder 3, the coolant gas flowing into the casing V is compressed in the cylinder 3 and then discharged by pushing the discharge valve assembly 9.

In this respect, the inner resonance springs 21, 31 and 41 supported by the magnet assembly 10 and the outer resonance springs 22, 32 and 42 supported between the magnet assembly 10 and the cover 2 store the linear reciprocal movement of the magnet assembly 10 including the piston 6 as an elastic energy, and induce the resonance movement of the magnet assembly 10 by converting the stored elastic energy to a linear movement.

As so far described, in the linear compressor according to the present invention, the inner circumferential surface of the inner stator assembly making a part of the stator is adhesively fixed at the outer circumferential surface of the cylinder, an outer stator assembly is disposed to have a gap with the inner stator assembly, the magnet assembly is inserted into the gap between the inner and the outer stator assemblies to make a resonance movement linearly, for which the inner resonance spring, among the inner and outer resonance spring rendering the magnet assembly to make resonance movement, is constructed to be supported by either the inner stator assembly or the outer stator assembly, to thereby remove the gap between the cylinder and the inner stator assembly and reduce the inner diameter of the inner stator assembly, according to which the inner diameter of the magnet assembly is minimized, remarkably reducing the amount of the magnet to be used and the size of the motor, and thus, its production cost can be much reduced.

In addition, since the inner resonance springs or the outer resonance spring are provided in plural number, its spring force can be dispersed and the mechanical reliability of the magnet assembly is highly improved.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such meets and bounds are therefore intended to be embraced by the appended claims.

What is claimed is:

1. A linear compressor comprising:

a cover fixed at a rear side of a frame;

a cylinder fixedly installed in a horizontal direction at the center of inside of the frame;

an inner stator assembly fixedly installed at the frame in a state that its inner circumferential surface contacts an outer circumferential surface of the cylinder;

an outer stator assembly fixedly installed at the frame, being spaced apart for a predetermined distance from the outer periphery of the inner stator assembly;

a magnet assembly incorporated with a piston, making a linear reciprocal movement with one end portion thereof inserted in the gap between the inner stator assembly and the outer stator assembly;

at least one inner resonance spring supported by the magnet assembly; and a plurality of outer resonance springs supported between the magnet assembly and the cover, wherein said at least one inner resonance spring and said plurality of outer resonance springs have an overlapping portion in a longitudinal direction.

2. The linear compressor according to claim 1, wherein the inner resonance spring is a sole compressive coil spring inserted between the rear side end portion of the inner stator assembly and the inner side surface of the magnet assembly.

3. The linear compressor according to claim 1, wherein a support portion of the magnet assembly is extended outwardly in the radial direction at a predetermined portion of the outer circumferential surface of the magnet assembly, and the outer resonance springs are a plurality of compressive coil springs inserted between the rear side surface of the support portion of the magnet assembly and the inner side surface of the cover.

4. The linear compressor according to claim 1, wherein the inner diameter of the inner resonance spring is greater than that of the inner stator assembly.

5. The linear compressor according to claim 1, wherein each of the plurality of outer resonance springs is made by a compressive coil spring having a larger inner diameter than the inner diameter of the inner resonance spring, and the plurality of outer resonance springs are installed to form a circle as seen in a longitudinal direction of the spring.

6. The linear compressor according to claim 1, wherein the inner resonance spring is a sole compressive coil spring inserted between the rear side end portion of the magnet assembly and the inner side surface of the cover.

7. The linear compressor according to claim 1, wherein a support portion of the magnet assembly extends from the rear side end portion of the outer circumferential surface of the magnet assembly by being bent outwardly in the radial direction, and the outer resonance springs are a plurality of compressive coil springs inserted between the front side surface of the support portion of the magnet assembly and the rear side end portion of the outer stator assembly.

8. The linear compressor according to claim 1, wherein the inner diameter of the inner resonance spring is greater than that of the inner stator assembly and smaller than that of the magnet assembly.

9. The linear compressor according to claim 1, wherein the plurality of outer resonance springs are formed by a compressive coil spring having a larger diameter than that of the inner resonance spring, and the plurality of outer resonance springs are installed to form a circle as seen in a longitudinal direction of the spring.

10. The linear compressor according to claim 1, wherein a support portion of the magnet assembly extends outwardly in the radial direction at the rear side end portion of the outer circumferential surface of the magnet assembly, and the inner resonance springs are a plurality of compressive coil springs inserted between the front side surface of the support portion of the magnet assembly and the rear side end portion of the outer stator assembly, and the outer resonance spring are a plurality of compressive coil springs inserted between the rear side surface of the support portion of the magnet assembly and the inner side surface of the cover.

* * * * *